US008789935B2

(12) United States Patent
Murata

(10) Patent No.: US 8,789,935 B2
(45) Date of Patent: Jul. 29, 2014

(54) INK CARTRIDGE CONTAINER

(71) Applicant: Seiya Murata, Kanagawa (JP)

(72) Inventor: Seiya Murata, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/746,639

(22) Filed: Jan. 22, 2013

(65) Prior Publication Data

US 2013/0215201 A1 Aug. 22, 2013

(30) Foreign Application Priority Data

Feb. 20, 2012 (JP) ..... 2012-034381

(51) Int. Cl.
*B41J 2/175* (2006.01)

(52) U.S. Cl.
USPC ..... 347/86

(58) Field of Classification Search
USPC ..... 347/84–87
See application file for complete search history.

(56) References Cited

U.S. PATENT DOCUMENTS

| | | | | |
|---|---|---|---|---|
| 5,157,421 | A * | 10/1992 | Kitahara | 347/86 |
| 6,830,322 | B2 * | 12/2004 | Shihoh et al. | 347/86 |
| 7,040,743 | B2 * | 5/2006 | Acosta et al. | 347/86 |
| 7,934,821 | B2 * | 5/2011 | Hattori | 347/86 |
| 8,104,881 | B2 | 1/2012 | Itoh | |

FOREIGN PATENT DOCUMENTS

| | | |
|---|---|---|
| JP | 59-6234 | 2/1984 |
| JP | 3342372 | 11/2002 |
| JP | 2008-12904 | 1/2008 |

* cited by examiner

*Primary Examiner* — Kristal Feggins
(74) *Attorney, Agent, or Firm* — Cooper & Dunham LLP

(57) ABSTRACT

An ink cartridge container includes an ink bag made of flexible material to store ink internally, the ink bag having a corner at an internal bottom surface thereof and an ink outlet at an upper part thereof, an ink delivery tube made of elastic material and situated inside the ink bag to deliver the ink to the outside through the ink outlet, an ink outlet connector connected to the ink delivery tube at the ink outlet to supply the ink to the outside, and a bending part to have the ink delivery tube inside be curved to have the end thereof in contact with the corner at the internal bottom surface, wherein the ink delivery tube inside the ink bag is positioned to have an end thereof in contact with the corner at the internal bottom surface by the bending part.

9 Claims, 8 Drawing Sheets

INK CARTRIDGE CONTAINER

BACKGROUND OF THE INVENTION

1. Field of the Invention

The disclosures herein generally relates to large-capacity ink cartridge containers used in inkjet printer systems.

2. Description of the Related Art

Recording apparatuses used in inkjet printer systems, in general, form images by discharging a required amount of ink droplets from multiple ink discharging nozzles on a printing head according to image processing results to be recorded onto required areas of recording media selectively.

Basic operations of the recording apparatuses used in inkjet printer systems are as follows. At first, a host such as a PC sends print commands and preprocessed image data to a printer via an interface. Then, based on the commands, a controller conveys recording media, drives mechanical sections, and executes other controlling operations such as supplying ink or maintaining heads.

Recording methods of the recording apparatuses used in inkjet printer systems are divided broadly into two categories. One is a serial printing method with which a printing head makes a reciprocal motion in a direction perpendicular to a conveyance direction of recording media. The other is a line printing method in which a printing head is fixed while printing.

The serial printing method can print on a large-surface media by lengthening a scanning distance of a carriage, without making a printing head larger. On the other hand, the line printing method is suitable for high-speed printing because a printing head does not need to make a scanning movement, although the printing head needs to have a length covering the width of the recording media.

The line printing method for high-speed printing requires a very large amount of ink at a unit time because a printing head has a length covering the width of the recording media as mentioned above. Therefore, it is common to use large-capacity ink cartridges for supplying ink to printing heads in order to minimize exchange operations and costs.

Also, it is common to use large-capacity ink cartridges with an ink outlet attached on an upper side of a container with respect to the center of the container, because if the ink outlet is attached to a lower side of the container with respect to the center, it may happen that all ink flows out from the container for some reason. In addition, it is desirable that a container is kept tightly closed except for the outlet, to avoid evaporation of liquid.

However, conventional large-capacity ink cartridge containers mentioned above used in the line printing method have problems that exist while ink is being consumed, whereas the shape of the container deforms irregularly, which forms multiple ink-remaining pools in the ink cartridge container. The ink remaining in the pools is difficult to reuse, resulting in waste ink.

To solve the problems, Japanese Laid-open Patent Publication No. 59-006234 discloses a flexible recording liquid container with a tightly closed structure, and a delivery tube with multiple holes on its surface, which is attached to the recording liquid container for delivering recording liquid out of the container.

Also, Japanese Patent No. 3342372 discloses an ink cartridge container having a flexible ink bag to store ink and an ink delivery tube in the bag to deliver the ink outside. The thickness of the bag around the neighborhood of the suctioning end of the S ink delivery tube is made thicker than other surface areas of the bag so that the flexible bag starts deforming from thin-surface areas, which may be away from the ink delivery tube.

However, when applying the configuration of the recording liquid container disclosed in Japanese Laid-open Patent Publication No. 59-006234, as it is, to a large-capacity ink cartridge container with an upper-sided ink outlet, a total length of the ink delivery tube becomes too long, which makes it difficult to bend and to position the ink delivery tube to cover all the interior of the recording liquid container. Therefore, the ink may still remain.

Also, the large-capacity ink cartridge container disclosed in Japanese Patent No. 3342372 has problems. Although the flexible ink bag has a thicker surface around the ink delivery tube than the other surface areas so that the flexible bag starts deforming with thin-surface areas away from the ink delivery tube, it is difficult to deform areas uniformly around ridgelines in the ink bag due to their complicated shapes. Therefore, the ink may still form multiple remaining ink pools.

SUMMARY OF THE INVENTION

To solve the above problems, an ink cartridge container used in inkjet printers includes an ink bag made of flexible material to store ink internally, the ink bag having a corner at an internal bottom surface thereof and an ink outlet at an upper part thereof, an ink delivery tube made of elastic material and situated inside the ink bag to deliver the ink stored in the ink bag to the outside through the ink outlet, an ink outlet connector connected to the ink delivery tube at the ink outlet to supply the ink in the ink bag to the outside, and a bending part to have the ink delivery tube inside be curved to have the end thereof in contact with the corner at the internal bottom surface, wherein the ink delivery tube inside the ink bag is positioned to have an end thereof in contact with the corner at the internal bottom surface by the bending part.

According to embodiments of the invention with the above configuration, if the ink bag shrinks while delivering ink with some ink remaining, the remaining ink at a corner of one of three ridgelines of the ink bag can be suctioned efficiently. Therefore, an amount of ink remaining is largely reduced for a large-capacity ink cartridge with an upper-sided ink outlet to prevent waste ink from being generated.

BRIEF DESCRIPTION OF THE DRAWINGS

Other objects and further features of embodiments will be apparent from the following detailed description when read in conjunction with the accompanying drawings, in which.

DESCRIPTION OF THE PREFERRED EMBODIMENTS

Figure 1:
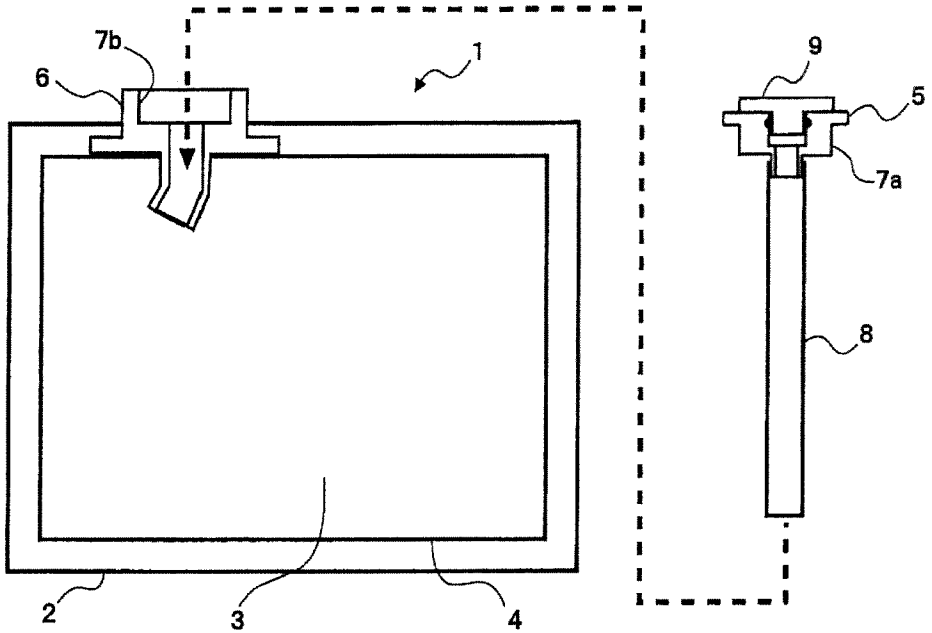
FIG. 1 is a general cross-sectional view illustrating an ink cartridge container 1 before assembly according to an embodiment of the invention.

In the following, embodiments of the present invention will be described with reference to the accompanying drawings. First, an assembly method of a large-capacity ink cartridge container 1 according to an embodiment of the invention will be explained with reference to FIGS. 1-3. FIG. 1 is a general cross-sectional view illustrating the ink cartridge container 1 before assembly. The ink cartridge container 1 includes a chassis 2 configured with six outer surfaces, an ink bag 4 made of flexible material used as an ink container 3, whose outer surfaces are substantially the same as inner surfaces of the chassis 2.

The ink bag 4 includes an ink outlet connector 5 and an ink outlet 6 to be connected with the ink outlet connector 5. The ink outlet 6 and the ink outlet connector 5 have screw threads 7*b*, 7*a* to be connected with each other. The ink outlet connector 5 is attached to an ink delivery tube 8 to deliver ink filling the inside of the ink cartridge container 1 to the outside, made of an elastic body.

The ink outlet connector 5 is attached with a preserving cap 9. The preserving cap 9 is provided to prevent the ink in the ink cartridge container 1 from leaking through the ink delivery tube 8 when the ink outlet connector 5 is not connected to a main body of a printer, which may be the case when transporting it for shipment, for example.

Figure 2:
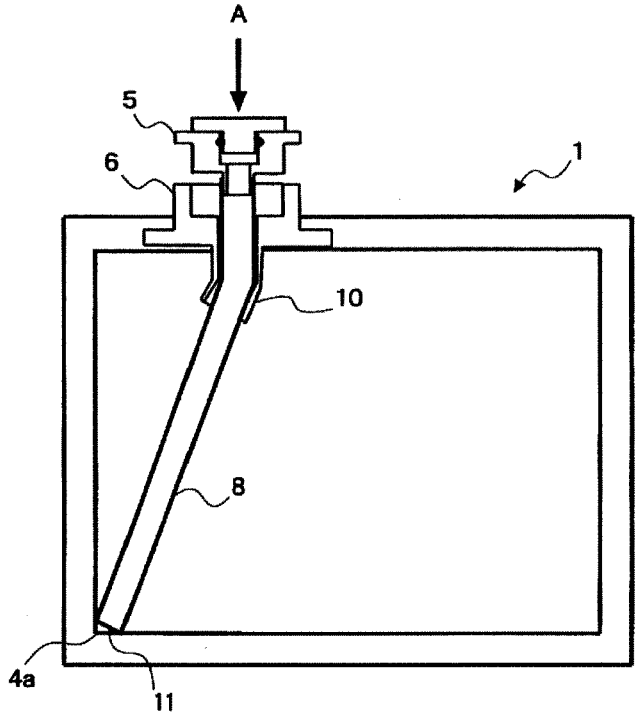
FIG. 2 is a general cross-sectional view illustrating the ink cartridge container 1 after assembly according to an embodiment of the invention.

Next, assembly steps of the ink cartridge container 1 will be explained with reference to FIG. 2. At first, ink is filled into the ink cartridge container 1. Next, the ink outlet 6 and the ink outlet connector 5 are connected with each other in a direction shown by an arrow "A" to seal the ink outlet 6.

Figure 3:
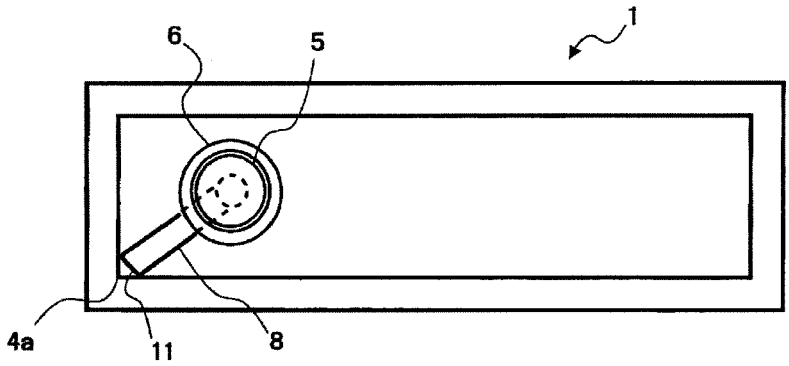
FIG. 3 is a top view illustrating the ink cartridge container 1 according to an embodiment of the invention

When connecting the ink outlet 6 with the ink outlet connector 5, a guiding member 10 provided with the ink outlet 6, or a bending part, is used to bend the ink delivery tube 8 in a direction toward a bottom corner 4*a*. With the guiding member 10, the ink delivery tube 8 can be assembled in the ink cartridge container 1 in such a way that the ink delivery tube 8 is positioned to make the end of the ink delivery tube 8, or an ink suctioning end of the ink delivery tube 8, come in contact with the bottom corner 4*a* in the ink cartridge container 1. FIG. 3 is a top view illustrating the ink cartridge container 1 according to the present embodiment of the invention.

Figure 4:
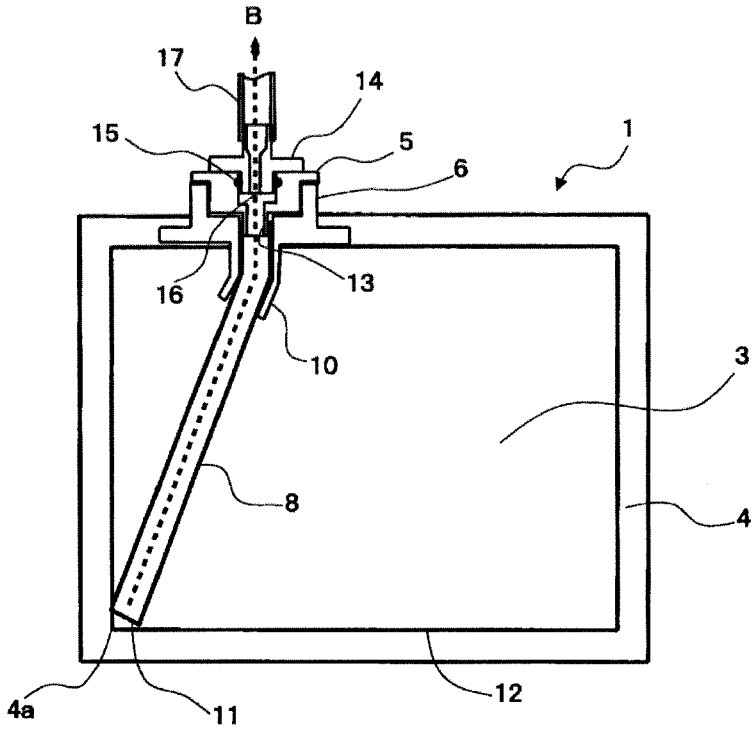
FIG. 4 is a cross-sectional view illustrating the ink cartridge container 1 after assembly according to an embodiment of the invention.
Figure 5:
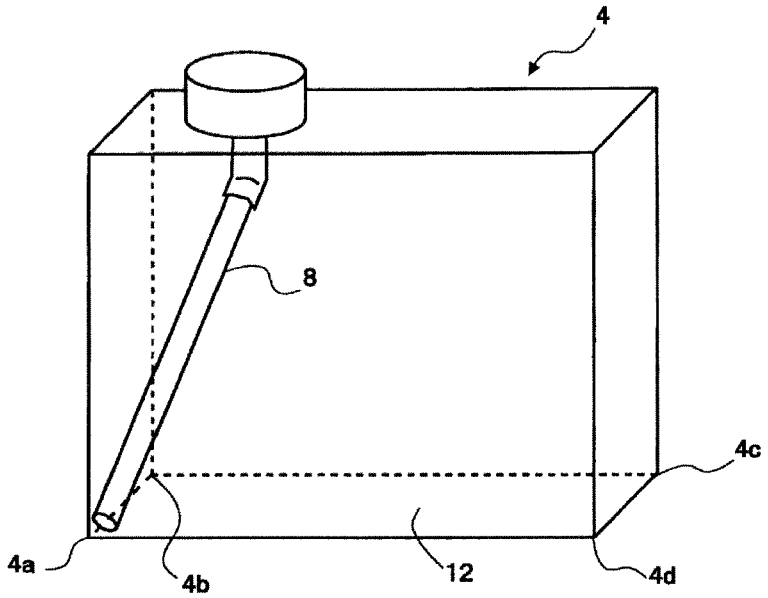
FIG. 5 is a perspective view illustrating an ink bag 4 according to an embodiment of the invention.
Figure 6:
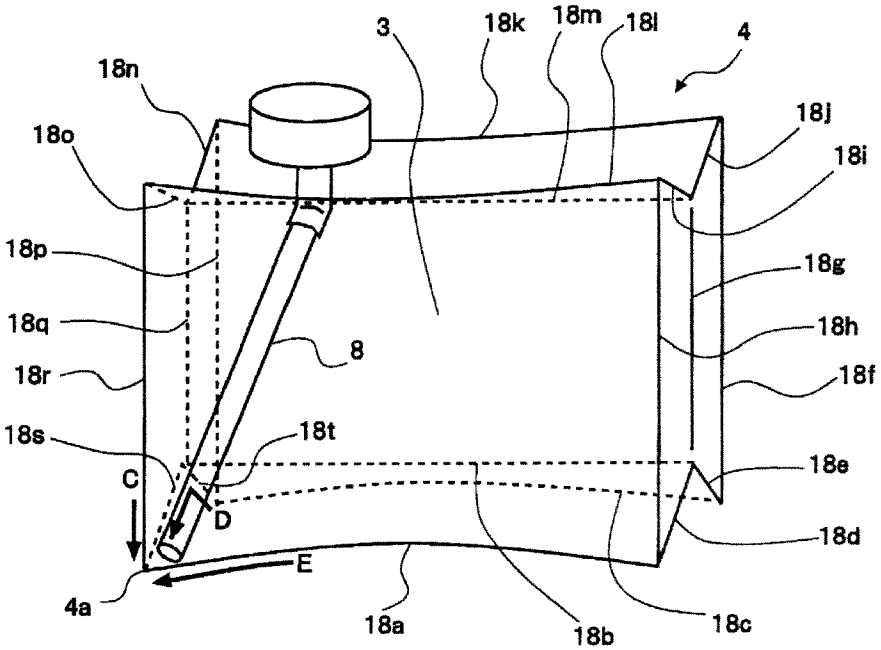
FIG. 6 is a perspective view illustrating the ink bag 4 deformed after suctioning ink according to an embodiment of the invention.

Next, a configuration of the ink cartridge container 1 will be explained with reference to FIGS. 4-6. FIG. 4 is a cross-sectional view illustrating the ink cartridge container 1 after assembly. FIG. 5 is a perspective view illustrating the ink bag 4. FIG. 6 is a perspective view illustrating the ink bag 4 deformed after suctioning ink.

As shown in FIG. 5, the ink bag 4 is configured with six planes, which forms bottom corners 4*a*, 4*b*, 4*c*, and 4*d* at intersections of at least three planes of internal surfaces. As described above, the ink bag 4 provides the ink outlet 6, and the ink delivery tube 8 connected via the ink outlet connector 5.

The ink delivery tube 8 is an elastic tube made of resin or the like to suction ink when submerged in the ink bag 4. The ink delivery tube 8 has sufficient strength to keep a shape of a pipe for delivering ink. Also, although the ink outlet connector 5 and the ink delivery tube 8 may be connected together with adhesives, it is preferable to be screwed in to increase types of ink to be accommodated.

Moreover, as shown in FIG. 4, the ink outlet 6 has the guiding member 10 to bend the ink delivery tube 6 in a direction toward the bottom corner 4*a*. With the guiding member 10, the end of the ink delivery tube 8 comes in contact with the bottom corner 4*a* on the bottom inner surface of the ink bag 4.

It is noted that although the guiding member 10 is attached to the ink outlet 6 in the present embodiment, it can be realized otherwise. As long as the end 11 of the ink delivery tube 8 is positioned to come in contact with the bottom corner 4*a* at the bottom of the ink bag 4, the guiding member 10 can be attached to anywhere, and the shape of the guiding member 10 can be any other shape.

It is also noted that, with the ink cartridge container 1 in the present embodiment, the guiding member 10 bends the ink delivery tube 8 to come in contact with the bottom corner 4*a*. Yet one of other bottom corners 4*b*, 4*c*, or 4*d* may be selected as long as the corners are on the inner surface of the bottom 12 as shown in FIG. 5.

The ink outlet connector 5 is assembled with a socket 13 for the ink delivery tube 8, as described before, and an O-ring 15 to connect a connector to the main body 14 as will be described later. The connector to the main body 14 has a suction mouth 16 to suction ink. The connector to the main body 14 is connected to an ink delivery tube 17 to supply ink to an inkjet line printer.

Next, suctioning of ink filling the ink bag 4 will be explained. The ink in the ink bag 4 is suctioned by a suctioning section (not shown here) such as a pump or the like provided at the outside of the ink delivery tube 17. When the suctioning section operates, the ink is delivered from the inside of the ink bag 4 to the outside, through an ink flowing passage formed with the ink delivery tube 8, the socket 13 for the ink delivery tube 8, the suction mouth 16, and the ink delivery tube 17, as designated by an arrow "B" in FIG. 4.

When delivering the ink in the ink container 3 from the ink cartridge container 1 through the ink delivery tube 17 as described above, the ink bag 4 deforms to shrink gradually as shown in FIG. 6.

When deforming, the ink bag 4 starts with deforming surfaces with lower rigidity. Therefore, ridgelines 18*a*-18*t* and their neighborhood, which have higher rigidity in the ink bag 4, may become ink-remaining areas communicating with each other. Remaining ink in these areas can be suctioned because the ink delivery tube 8 is positioned to come in contact with the bottom corner 4*a* in the ink bag 4, to which the remaining ink gathers on the ridgelines along arrows designated with C, D, or E.

Moreover, since the bottom corner 4*a* in the ink bag 4 is at a cross point of three ridgelines 18*a*, 18*r*, and 18*s*, all the remaining ink on the ridgelines in the ink cartridge container 1 can be effectively suctioned to reduce an amount of remaining ink.

[Modified Embodiment 1]

Figure 7:
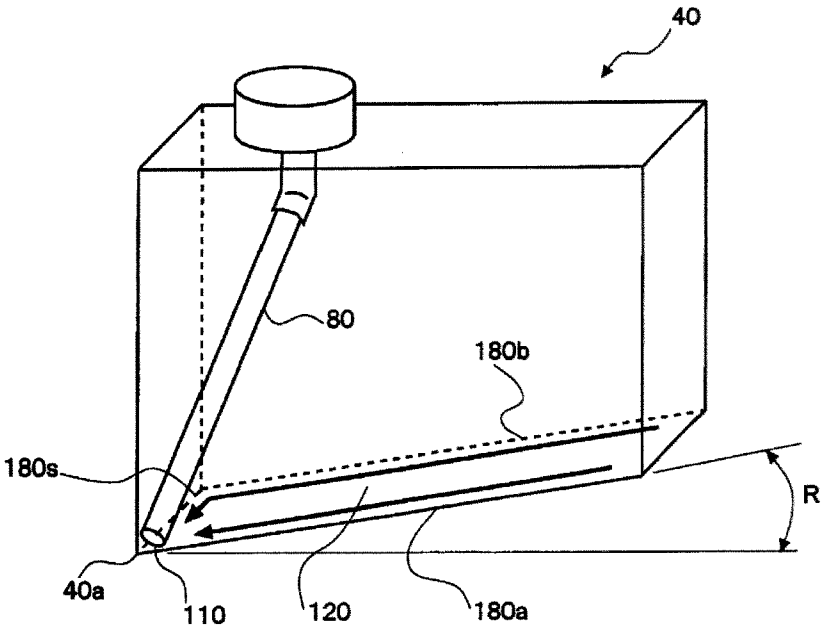
FIG. 7 is a perspective view illustrating an ink bag 40 having a slope at a bottom 120 according to a modified embodiment of the invention.

FIG. 7 is a perspective view illustrating an ink bag 40 having a downward slope R at a bottom 120 to a bottom corner 40*a* in contact with an ink delivery tube 80 as a modified embodiment of the invention. With providing the slope R, remaining ink at ridgelines 180*a*, 180*b*, and 180*s* can be effectively guided to gather at the end 110 of the ink delivery tube BO. Therefore, it is possible to further reduce waste ink in the ink bag with a simple and inexpensive configuration.

[Modified Embodiment 2]

Figure 8:
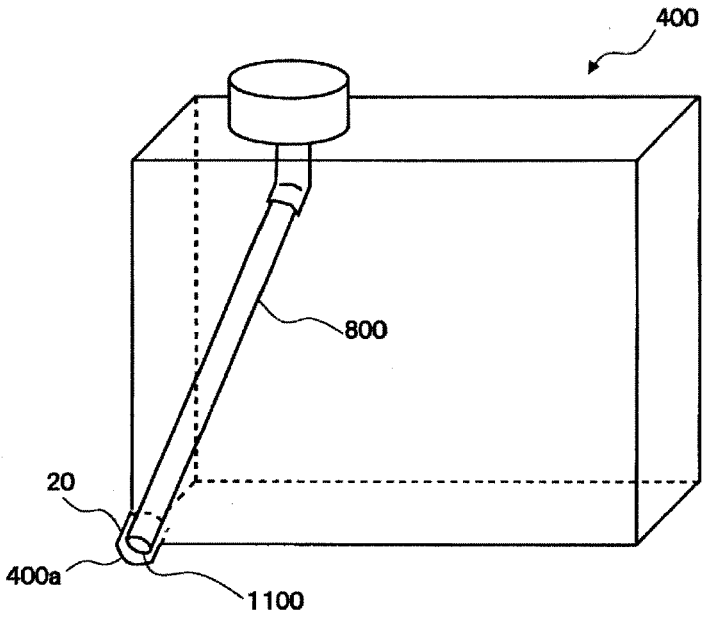
FIG. 8 is a perspective view illustrating an ink bag 400 having a concave portion 20 around one of corners of a bottom where an ink delivery tube 800 comes in contact with the ink bag 400*a* according to a modified embodiment of the invention.

FIG. 8 is a perspective view illustrating an ink bag 400 having a concave portion 20 around a corner 400*a* of a bottom where an ink delivery tube 800 is held according to another modified embodiment of the invention. It is noted that the concave portion 20 is concave when viewed from the inside of the ink bag. With providing the concave portion 20, an off-position of an ink delivery tube can be avoided, which could happen during transportation of an ink cartridge container, or by external shocks. Since an off-position of the ink delivery tube can be avoided, the end 1100 of the ink delivery tube is always securely positioned to the bottom corner, resulting in a minimum variation of remaining ink.

[Modified Embodiment 3]

Figure 9:
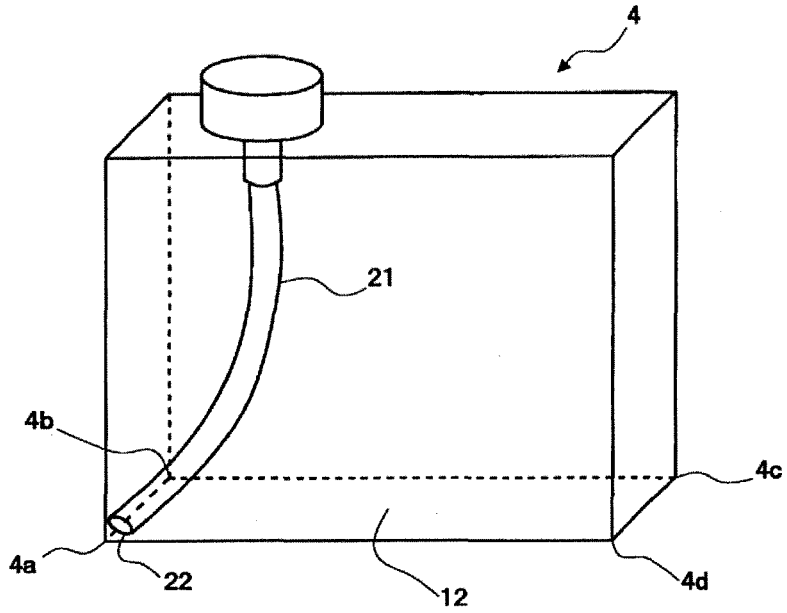
FIG. 9 is a perspective view illustrating an ink delivery tube curved in the middle according to a modified embodiment of the invention.

FIG. 9 is a perspective view illustrating an ink delivery tube 21 curved in the middle instead of using a guiding member 10, according to yet another modified embodiment of the invention. By using the ink delivery tube 21 curved in the middle, it is possible to assemble the ink delivery tube 21 with its end 22 coming in contact with the bottom corner 4*a* in the ink cartridge container 1. The end 22 of the ink delivery tube 21 may come in contact with one of other bottom corners 4*b*, 4*c*, or 4*d* as long as the corners are on the inner surface of the bottom 12.

According to an embodiment of the invention, an ink cartridge container used in inkjet printers includes an ink bag made of flexible material to store ink internally, a chassis to accommodate the ink bag, an ink delivery tube made of elastic material to deliver the ink stored in the ink bag to the outside, an ink outlet connector to connect with the ink delivery tube to supply the ink in the ink bag to a main body of a printer, and a bending part to bend the ink delivery tube to make an end of the ink delivery tube come in contact with a bottom corner in the ink bag.

With the above configuration, when the ink bag is shrunk during ink delivery, the remaining ink on ridgelines in the large-capacity ink cartridge container with an upper-sided ink outlet can be effectively suctioned at a bottom corner at a cross point of the three ridgelines, to largely reduce an amount of remaining ink.

According to an embodiment of the invention, an ink cartridge container used in inkjet printers includes an ink bag made of flexible material to store ink internally, a chassis to accommodate the ink bag, an ink delivery tube made of elastic material to deliver the ink stored in the ink bag to the outside, an ink outlet connector connected with the ink delivery tube to supply the ink in the ink bag to a main body of a printer, wherein the ink delivery tube is preformed in such a curved shape that an end of the ink delivery tube comes in contact with one of bottom corners in the ink bag.

With the above configuration, when the ink bag is shrunk during ink delivery, remaining ink on the ridgelines in the large-capacity ink cartridge container with an upper-sided ink outlet can be effectively suctioned at a bottom corner at a cross point of the three ridgelines, to largely reduce an amount of remaining ink.

According to an embodiment of the invention, the bottom of an ink bag has a slope to gather ink at the end of the ink delivery tube. With providing the slope, remaining ink at ridgelines at the bottom can be effectively guided and gathered at the end of the ink delivery tube. Therefore, it is possible to further reduce waste ink in the ink bag with a simple and inexpensive configuration.

According to an embodiment of the invention, an ink bag has a concave portion around one of corners at a bottom where an ink delivery tube comes in contact with the ink bag. With providing the concave portion, an off-position of the ink delivery tube can be avoided, which could happen during transportation of the ink cartridge container, or by external shocks. Since an off-position of the ink delivery tube can be avoided, the end of the ink delivery tube is always securely positioned to the bottom corner, resulting in a minimum variation of remaining ink. Moreover, it is possible to provide ink cartridge containers, not only with a simple and inexpensive configuration to reduce waste ink, but also with higher reliability.

The disclosures herein are generally applicable to liquid containers used in liquid discharge apparatuses configured to use liquid for printing.

Further, the present invention is not limited to these embodiments, but various variations and modifications may be made without departing from the scope of the present invention.

The present application is based on Japanese Priority Application No. 2012-034381, filed on Feb. 20, 2012, with the Japanese Patent Office, the entire contents of which are hereby incorporated by reference.

What is claimed is:

1. An ink cartridge container comprising:

an ink bag made of flexible material to store ink internally, the ink bag having a corner at an internal bottom surface thereof and an ink outlet at an upper part thereof;

an ink delivery tube made of elastic material and situated inside the ink bag to deliver the ink stored in the ink bag to the outside through the ink outlet;

an ink outlet connector connected to the ink delivery tube at the ink outlet o supply the ink in the ink bag to the outside; and a bending part to have the ink delivery tube inside be curved to have the end thereof in contact with the corner at the internal bottom surface, wherein the ink delivery tube inside the ink bag is positioned to have an end thereof in contact with the corner at the internal bottom surface by the bending part, and wherein the bending part is a guiding member attached at the ink outlet connector.

2. The ink cartridge container as claimed in claim 1, wherein the ink delivery tube is preformed in such a curved shape that the end thereof comes in contact with the corner at the internal bottom surface.

3. The ink cartridge container as claimed in claim 1, wherein the internal bottom surface of the ink bag has a slope to gather ink to the end of the ink delivery tube.

4. The ink cartridge container as claimed in claim 1, wherein the ink bag has a concave portion around the corner at the internal bottom surface where the end of the ink delivery tube is fit into to come in contact with the internal bottom surface of the ink bag.

5. An ink cartridge container comprising:

an ink bag made of flexible material to store ink internally, the ink bag having a corner at an internal bottom surface thereof and an ink outlet at an upper part thereof;

an ink delivery tube made of elastic material and situated inside the ink bag to deliver the ink stored in the ink bag to the outside through the ink outlet;

an ink outlet connector connected to the ink delivery tube at the ink outlet to supply the ink in the ink bag to the outside; and a bending part to have the ink delivery tube inside be curved to have the end thereof in contact with the corner at the internal bottom surface, wherein the ink delivery tube inside the ink bag is positioned to have an end thereof in contact with the corner at the internal bottom surface by the bending part, and wherein the internal bottom surface of the ink bag has a slope to gather ink to the end of the ink delivery tube.

6. The ink cartridge container as claimed in claim 5, wherein the ink delivery tube is preformed in such a curved shape that the end thereof comes in contact with the corner at the internal bottom surface.

7. An ink cartridge container comprising:

an ink bag made of flexible material to store ink internally, the ink bag having a corner at an internal bottom surface thereof and an ink outlet at an upper part thereof;

an ink delivery rube made of elastic material and situated inside the ink bag to deliver the ink stored in the ink bag to the outside through the ink outlet;

an ink outlet connector connected to the ink delivery tube at the ink outlet to supply the ink in the ink baa to the outside; and a bending part to have the ink delivery tube inside be curved to have the end thereof in contact with the corner at the internal bottom surface, wherein the ink delivery tube inside the ink bag is positioned to have an end thereof in contact with the corner at the internal bottom surface by the bending part, and wherein the ink bag has a concave portion around the corner at the internal bottom surface where the end of the ink delivery tube is fit into to come in contact with the internal bottom surface of the ink bag.

8. The ink cartridge container as claimed in claim 7, wherein the ink delivery tube is preformed in such a curved shape that the end thereof comes in contact with the corner at the internal bottom surface.

9. The ink cartridge container as claimed in claim 7, wherein the internal bottom surface of the ink bag has a slope to gather ink to the end of the ink delivery tube.

* * * * *